US010753173B2

(12) United States Patent
Voll et al.

(10) Patent No.: US 10,753,173 B2
(45) Date of Patent: Aug. 25, 2020

(54) RETRIEVABLE PACKER

(71) Applicant: SWELLFIX B.V., Rijswijk ZH (NL)

(72) Inventors: Benn Voll, Hundvaag (NO); Barry Huffer, Brighton (AU); Colin Mackie, Aberdeen (GB); Neil Anderson, Aberdeen (GB)

(73) Assignee: Swellfix B.V., Rijswijk ZH (NL)

( * ) Notice: Subject to any disclaimer, the term of this patent is extended or adjusted under 35 U.S.C. 154(b) by 193 days.

(21) Appl. No.: 14/909,506

(22) PCT Filed: Jul. 29, 2014

(86) PCT No.: PCT/EP2014/066291
§ 371 (c)(1),
(2) Date: Feb. 2, 2016

(87) PCT Pub. No.: WO2015/032553
PCT Pub. Date: Mar. 12, 2015

(65) Prior Publication Data

US 2016/0177659 A1 Jun. 23, 2016

(30) Foreign Application Priority Data

Sep. 6, 2013 (GB) ..... 1315957.9

(51) Int. Cl.
*E21B 33/12* (2006.01)
*E21B 33/128* (2006.01)
*E21B 33/127* (2006.01)

(52) U.S. Cl.
CPC ..... *E21B 33/128* (2013.01); *E21B 33/1208* (2013.01); *E21B 33/1277* (2013.01)

(58) Field of Classification Search
CPC . E21B 33/128; E21B 33/1208; E21B 33/1277
See application file for complete search history.

(56) References Cited

U.S. PATENT DOCUMENTS 3,460,616 A * 8/1969 Crow ..... E21B 33/1295 166/120
5,048,605 A * 9/1991 Toon ..... E21B 33/1277 166/187

(Continued)

FOREIGN PATENT DOCUMENTS

CA 2805073 A1 1/2012
EP 2407632 A2 1/2012

(Continued)

OTHER PUBLICATIONS

International Search Report PCT/ISA/210 for International Application No. PCT/EP2014/066291 dated Jul. 3, 2015.

(Continued)

*Primary Examiner* — Matthew R Buck
*Assistant Examiner* — Aaron Lloyd Lembo
(74) *Attorney, Agent, or Firm* — Harness, Dickey & Pierce, P.L.C.

(57) ABSTRACT

A retrievable packer device for use in a wellbore includes first and second end rings configured to be mounted on a base member and a deformable sleeve extending from the first end ring to the second end ring and configured to extend around the base member. A swellable sleeve is mounted on the deformable sleeve.

39 Claims, 2 Drawing Sheets

(56) References Cited

U.S. PATENT DOCUMENTS 5,195,583 A * 3/1993 Toon ..... E21B 33/1243 166/179
5,375,662 A * 12/1994 Echols, III ..... E21B 23/04 166/187
6,286,603 B1 * 9/2001 Parent ..... E21B 33/1208 166/187
7,252,142 B2 * 8/2007 Brezinski ..... E21B 33/12 166/191
7,363,986 B2 * 4/2008 Brezinski ..... E21B 33/12 166/179
7,832,490 B2 * 11/2010 Willauer ..... C08K 3/08 166/195
8,235,108 B2 * 8/2012 Lemme ..... B29C 45/1671 166/179
8,794,310 B2 * 8/2014 Allen ..... E21B 33/1208 166/179
2001/0037881 A1 * 11/2001 Brecheisen ..... E21B 33/127 166/106
2008/0185158 A1 * 8/2008 Chalker ..... E21B 33/1208 166/387
2009/0229816 A1 9/2009 Lemme et al.
2010/0116496 A1 5/2010 Allen et al.

FOREIGN PATENT DOCUMENTS

EP 2479376 A1 7/2012
WO WO-2013135415 A1 9/2013

OTHER PUBLICATIONS

Written Opinion of the International Searching Authority PCT/ISA/237 for International Application No. PCT/EP2014/066291 dated Jul. 3, 2015.
Search Report for corresponding Great Britain Application No. GB1315957.9 dated Oct. 16, 2014.

* cited by examiner 9
40
46
30
12
48
32
6
16
24, 25
14
44
42
10
4
9
18
19
34, 35
36
26
22
20
15
17
2
8

12
36
16
14
10
2
8
4

12
36
30
14
16
10
2
8
4

9
12
60
18
16
14
24
10
2
8
4

RETRIEVABLE PACKER

CROSS-REFERENCE TO RELATED APPLICATIONS

This is a National Phase of PCT Patent Application No. PCT/EP2014/066291, filed on Jul. 29, 2014, and claims priority to, Great Britain Application No. 1315957.9, filed Sep. 9, 2013, the contents of each of which are hereby incorporated by reference in their entirety.

FIELD OF THE INVENTION

The present invention relates to a retrievable packer device and a retrievable packer assembly for use in a wellbore, particularly though not exclusively, for use in a wellbore tubular or a borehole of an oil, gas or water well.

BACKGROUND TO THE INVENTION

It is well known to use packers for the purposes of sealing fluid flow paths in oil and gas wells such as oil and gas production wells and in water wells such as injection wells. For example, it is well known to sealingly mount such downhole packers on a base pipe and to prevent fluid flow along an annulus defined between an outer surface of the base pipe and an inner surface of a wellbore. Such downhole packers may, in particular, be used for isolating production zones in an oil or gas well. Such packers generally include a sealing element which, in use, exerts a sufficient pack-off force on an inner surface of the wellbore so as to provide an effective seal to fluid flow. Known downhole packers may include a deformable non-swellable sealing element which, in use, exerts a radially outward pack-off force on the inner surface of the wellbore in response to axial compression of the sealing element. The sealing element may be axially compressed by a variety of different methods which may include at least one of: the application of hydraulic pressure to a setting tool; the application of pressure into an integral setting chamber of the packer; the application of a set down weight; the application of over pull; and the use of a pyrotechnic method involving the use of slow-burning explosives.

Swellable packers are also known which include a swellable sealing element which, in use, exerts a radially outward pack-off force on the inner surface of the wellbore on exposure of the sealing element to one or more fluids present in the wellbore. Swellable packers are generally mechanically simpler and less complex than deformable non-swellable packers.

In some circumstances, it may be necessary or desirable to retrieve a packer from the wellbore, for example to permit well measurements, observations and/or well intervention operations to be performed. Deformable non-swellable packers are generally retrieved by releasing the mechanism that maintains the pack-off force and then pulling the base pipe out of the wellbore with the packer mounted thereon. The retrieval of deformable non-swellable packers generally requires well intervention to release the mechanism that maintains the pack-off force. Well intervention is, however, relatively expensive.

In the case of a conventional swellable packer, it may not be possible to reverse the swelling of the swellable sealing element to permit easy retrieval of the swellable packer. In order to retrieve such a packer, it is generally necessary to apply a sufficient pulling force to the base pipe to overcome the considerable friction forces which arise between the outer surface of the swollen sealing element and the inner surface of the wellbore. Dragging a packer out of the wellbore in this way may cause disintegration of the sealing element. This may prevent re-use of at least some of the packer parts. In addition, debris may be generated in the wellbore which may be prejudicial to subsequent well measurements, observations and/or intervention operations. Moreover, the friction forces may be considerable, thereby requiring the use of high pull forces. Accordingly, dragging a conventional swellable packer out of a wellbore may be time-consuming and/or expensive. This may be particularly true when trying to retrieve multiple packers mounted on the same base pipe at the same time.

SUMMARY OF THE INVENTION

According to a first aspect of the present invention there is provided a retrievable packer device for use in a wellbore, comprising:

first and second end rings configured to be mounted on a base member;

a deformable sleeve extending from the first end ring to the second end ring and configured to extend around the base member; and a swellable sleeve mounted on the deformable sleeve, wherein the deformable sleeve is supported by the first and second end rings.

The deformable sleeve is supported by the first and second end rings so as to define a chamber between an outer surface of the base pipe and an inner surface of the deformable sleeve. The chamber may extend axially between the first and second end rings. The provision of such a chamber may permit the deformable sleeve to deform radially inwardly according to the lateral force exerted by the swellable sleeve on the deformable sleeve.

The deformable sleeve may be sufficiently rigid so as to support a lateral force exerted by the swellable sleeve on the deformable sleeve resulting from the exertion of a pack-off force from the swellable sleeve against a surface adjacent to the swellable sleeve such as the surface of a tubular or a borehole.

The deformable sleeve may comprise a metal, for example steel.

The deformable sleeve may have a wall thickness in the range of 1 to 5 mm, 1.5 to 3 mm or 2 to 2.5 mm.

The deformable sleeve may define a plurality of axially extending grooves or slots. The grooves or slots may be distributed circumferentially around the deformable sleeve. The grooves or slots may only extend axially along a middle axial portion of the deformable sleeve.

The deformable sleeve may be joined to the first end ring.

The deformable sleeve may be joined to the first end ring in a region of a first end of the deformable sleeve.

A first end region of the deformable sleeve may be received within a complementary annular recess defined by the first end ring, for example a complementary annular recess defined in an axial end face of the first end ring.

The deformable sleeve may be joined to the first end ring around a path defined on an outer surface of the deformable sleeve.

The deformable sleeve may be joined to the first end ring around a path defined on an inner surface of the deformable sleeve.

The deformable sleeve may be welded to the first end ring.

The deformable sleeve may be bonded or adhered to the first end ring.

The deformable sleeve may be formed integrally with the first end ring.

The deformable sleeve may be sealed relative to the first end ring so as to prevent fluid flow therebetween.

The deformable sleeve may be selectively sealed relative to the second end ring according to a lateral force exerted by the swellable sleeve on the deformable sleeve.

The deformable sleeve may be movable relative to the second end ring.

The deformable sleeve may be movable relative to the second end ring so as to provide a selective seal relative to the second end ring according to a lateral force exerted by the swellable sleeve on the deformable sleeve.

The deformable sleeve may be selectively sealed relative to the second end ring in a region of a second end of the deformable sleeve.

A second end region of the deformable sleeve may be slidingly received within a complementary annular recess defined in the second end ring, for example a complementary annular recess defined in an axial end face of the second end ring.

The second end ring may comprise an O-ring seal located within a circumferential groove defined in a sidewall of the annular recess defined in the second end ring. A surface of the second end region of the deformable sleeve may define a sealing area which is disposed towards the O-ring seal. The sealing area may selectively engage the O-ring seal according to a lateral force exerted by the swellable sleeve on the deformable sleeve. The sealing area may be defined by circumferential grooves located either side of the sealing area.

The deformable sleeve may comprise an O-ring seal located within a circumferential groove defined in a surface of the second end region of the deformable sleeve. A sidewall of the annular recess defined in the second end ring may define a sealing area which is disposed towards the O-ring seal. The sealing area may selectively engage the O-ring seal according to a lateral force exerted by the swellable sleeve on the deformable sleeve. The sealing area may be defined by circumferential grooves located either side of the sealing area.

The deformable sleeve may be selectively supported by the second end ring according to a lateral force exerted by the swellable sleeve on the deformable sleeve.

The deformable sleeve may be de-supported according to the lateral force exerted by the swellable sleeve on the deformable sleeve. This may permit the de-deformable sleeve to collapse radially. For example, this may permit a de-supported end or a de-supported end region of the deformable sleeve to collapse radially. This may permit the swellable sleeve to collapse radially. For example, this may permit a de-supported end or a de-supported end region of the swellable sleeve to collapse radially.

The first and second end rings may be selectively sealable relative to a base member.

The first and second end rings may each comprise an inner seal mounted on an inner surface thereof.

Each inner seal may be configured to selectively seal between an inner surface of the corresponding end ring and an outer surface of a base member.

The inner seal of each of the first and second end rings may comprise a swellable material.

The swellable sleeve may be sealingly mounted on the deformable sleeve.

The swellable sleeve may be bonded to an outer surface of the deformable sleeve.

The swellable sleeve may be bonded to the first end ring, for example to an axial end face of the first end ring.

The packer device may comprise at least one control line.

The control line may provide for the transfer of an electrical signal, an optical signal or a fluid through the packer device.

The control line may comprise an electrical cable, an optical fibre or a fluid line.

The packer device may be configured to accommodate the control line. The packer device may, for example, comprise one or more through bore is, slots, slits, channels or the like for this purpose.

It should be understood that one or more of the optional features disclosed in relation to one aspect of the present invention may apply alone or in any combination in relation to any other aspect of the present invention.

According to a second aspect of the present invention there is provided a retrievable packer assembly, comprising:

a base member;

first and second end rings mounted on the base member;

a deformable sleeve extending from the first end ring to the second end ring around the base member; and a swellable sleeve mounted on the deformable sleeve, wherein the deformable sleeve is supported by the first and second end rings.

The first end ring of the packer may be attached to the base member using at least one connector.

The first end ring of the packer may be attached to the base member using at least one set screw, grub screw or the like.

The second end ring of the packer may be attached to the base member using at least one connector.

The second end ring of the packer may be attached to the base member using at least one frangible connector.

The second end ring of the packer may be attached to the base member using at least one shear screw.

The base member may comprise an end stop at or adjacent to an end thereof. The end stop may be configured to prevent sliding of the second end ring past the end stop. The end stop may be defined by a coupling member configured to permit coupling of the base member to an adjacent further base member.

The retrievable packer assembly may comprise a plurality of retrievable packer devices mounted on the base member.

Each packer device may be the same or different.

It should be understood that one or more of the optional features disclosed in relation to one aspect of the present invention may apply alone or in any combination in relation to any other aspect of the present invention.

According to a third aspect of the present invention there is provided a method of retrieving a packer assembly from a wellbore, the packer assembly comprising:

a base member;

first and second end rings mounted on the base member;

a deformable sleeve extending from the first end ring to the second end ring around the base member; and a swellable sleeve mounted on the deformable sleeve, wherein the deformable sleeve is supported by the first and second end rings and the method comprises:

exerting a pulling force on the base pipe so as to deform the swellable sleeve and the deformable sleeve.

The deformable sleeve is supported by the first and second end rings so as to define a chamber between an outer surface of the base pipe and an inner surface of the deformable sleeve. The chamber may extend axially between the first and second end rings. The provision of such a chamber may permit the deformable sleeve to deform radially inwardly according to the lateral force exerted by the swellable sleeve on the deformable sleeve. This may reduce the pulling force required to withdraw the packer assembly from a wellbore.

The method may comprise exposing the packer assembly to well fluids. This may permit well fluids to flow into the annular chamber.

The first and second end rings may be selectively sealable relative to the base member. The first and second end rings may each comprise an inner O-ring seal for this purpose. The inner or ring seals may comprise a swellable material.

The deformable sleeve may be joined to the first end ring.

The deformable sleeve may be selectively sealed relative to the second end ring according to a lateral force exerted by the swellable sleeve on the deformable sleeve.

The deformable sleeve may be movable relative to the second end ring.

The deformable sleeve may be movable relative to the second end ring so as to provide a selective seal relative to the second end ring according to a lateral force exerted by the swellable sleeve on the deformable sleeve.

The method may comprise increasing the pulling force on the base pipe so as to break the seal between the deformable sleeve and the second end ring and permit fluid to flow between the deformable sleeve and the second end ring. This may permit fluid present in the annular chamber to be vented from the annular chamber for the equalisation of pressures inside and outside of the annular chamber. This may permit further deformation of the deformable sleeve. This may reduce the pulling force required to withdraw the packer assembly from a wellbore.

The deformable sleeve may be selectively supported by the second end ring according to a lateral force exerted by the swellable sleeve on the deformable sleeve.

The method may comprise exerting a sufficient pulling force on the base pipe so as to increase the lateral force exerted by the swellable sleeve on the deformable sleeve sufficiently to disengage the deformable sleeve from the second end ring. This may cause the deformable sleeve to become de-supported by the second end ring. This may permit the de-deformable sleeve to collapse radially. For example, this may permit a de-supported end or a de-supported end region of the deformable sleeve to collapse radially. This may permit the swellable sleeve to collapse radially. For example, this may permit a de-supported end or a de-supported end region of the swellable sleeve to collapse radially. This may further reduce the pulling force required to withdraw the packer assembly from a wellbore.

The method may comprise exerting a sufficient pulling force on the base pipe so as to separate the first end ring from the swellable sleeve, for example to separate an axial end face of the first end ring from an axial end face of the swellable sleeve.

The method may comprise exerting a sufficient pulling force on the base pipe so as to shear a shear screw attaching the second end ring to the base member. This may permit the first end ring and the deformable sleeve to separate axially from the second end ring. This may overcome a bond between the deformable sleeve and the swellable sleeve. This may further de-support the swellable sleeve to allow the further radial collapse thereof.

It should be understood that one or more of the optional features disclosed in relation to one aspect of the present invention may apply alone or in any combination in relation to any other aspect of the present invention.

BRIEF DESCRIPTION OF THE DRAWINGS

The present invention will be further described by way of non-limiting example only with reference to the following figures of which.

DETAILED DESCRIPTION

Terms such as "up", "down", "upward", "downward", "uphole", "downhole", "upper", "lower" and the like are used below for ease of illustration only. One skilled in the art will understand that such terms are intended to refer to the particular orientation of the features shown, but are not intended to be limiting. For example, terms such as "up", "upward", "uphole" and "upper" may be used to refer to a direction along a wellbore towards a point of entry of the wellbore into a surface such as the ground or the seabed, whilst terms such as "down", "downward", "downhole" and "lower" may be used to refer to a direction along a wellbore away from the point of entry. As such, when a wellbore is deviated from the vertical, such terms may refer to a direction which differs significantly from a vertical direction and may even refer to a horizontal direction.

Figures 1A, 1B, 1C, 1D:
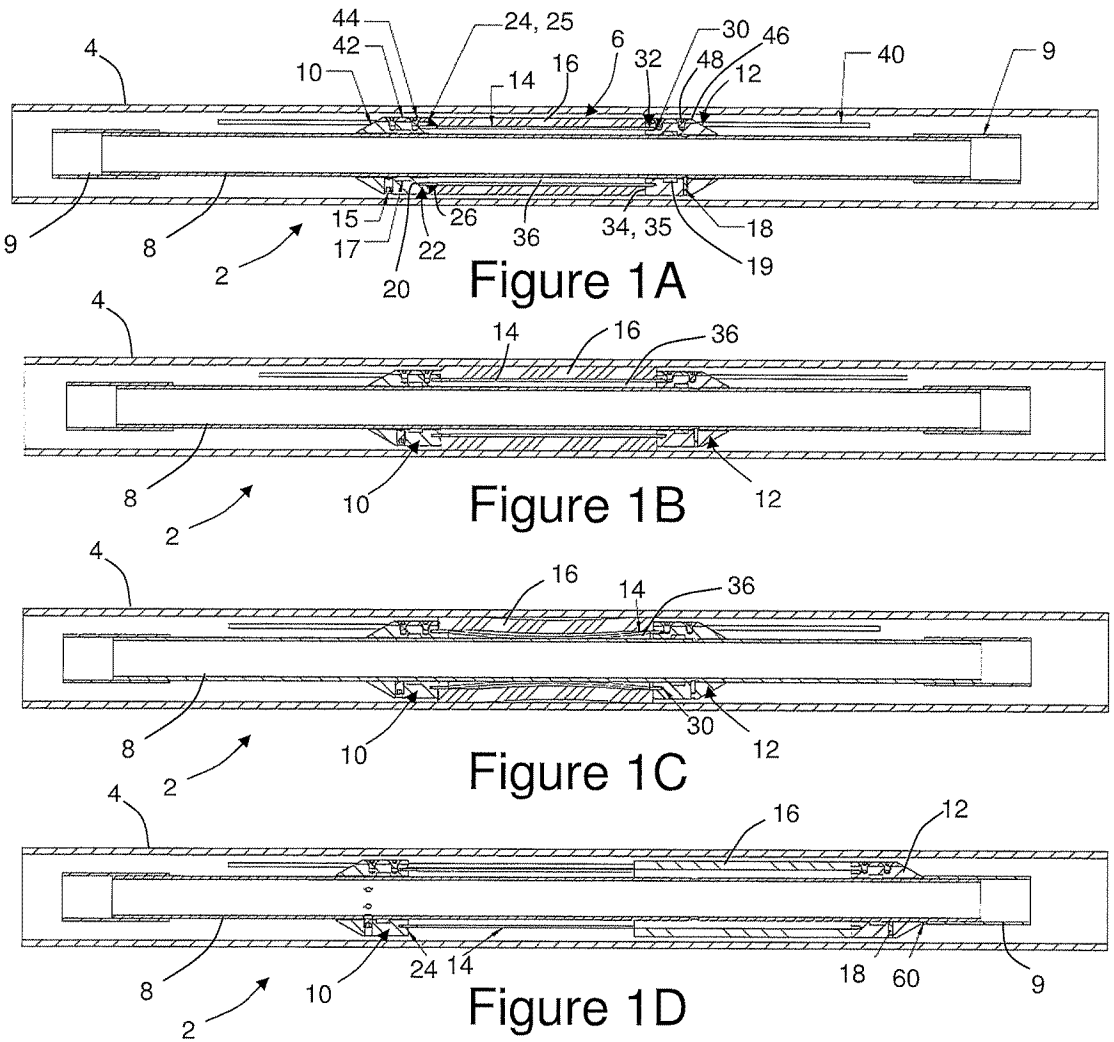
FIG. 1A is a longitudinal cross-section of a swellable packer assembly located within a wellbore prior to setting of the packer assembly.
FIG. 1B is a longitudinal cross-section of the packer assembly of FIG. 1A after setting of the packer assembly.
FIG. 1C is a longitudinal cross-section of the packer assembly of FIG. 1B on application of an initial uphole force to a base pipe of the packer assembly during retrieval of the packer assembly from the wellbore.
FIG. 1D is a longitudinal cross-section of the packer assembly of FIG. 1C on application of an uphole force to the base pipe which is greater than the initial uphole force.

Referring initially to FIG. 1A there is shown a swellable packer assembly generally designated 2 located within a wellbore tubular in the form of a wellbore casing 4 prior to setting of the packer assembly 2. The packer assembly 2 includes a packer device generally designated 6 mounted on a base member in the form of a base pipe 8. The base pipe 8 includes a coupling 9 at either end thereof for coupling the base pipe 8 to a tubular string (not shown) such as a completion string or a production string (not shown). The packer assembly 2 may be run into the wellbore casing 4 on the tubular string (not shown) prior to setting of the packer device 6. As will be described in more detail below, the tubular string (not shown) may also be used for pulling the packer assembly 2 out of the wellbore casing 4 some time after the packer device 6 has been set.

The packer device 6 includes an upper end ring 10 and a lower end ring 12. The packer device 6 includes a deformable sleeve 14 which extends around the base pipe 8 from the upper end ring 10 to the lower end ring 12. The deformable sleeve 14 is formed from steel and has a wall thickness in the range of 1.5 mm to 3 mm. The packer device 6 includes a swellable sealing sleeve 16 bonded to an outer surface of the deformable sleeve 14. The upper end ring 10 is fixed to the base pipe 8 by one or more set screws 15. The upper end ring 10 is provided with a swellable inner O-ring seal 17 for sealing an inner surface of the upper end ring 10 against an outer surface of the base pipe 8. The lower end ring 12 is frangibly connected to the base pipe 8 by one or more shear screws 18. The lower end ring 12 is provided with a swellable inner O-ring seal 19 for sealing an inner surface of the lower end ring 12 against the outer surface of the base pipe 8.

The deformable sleeve 14 is supported by the upper end ring 10. As will be described in more detail below, the deformable sleeve 14 is axially moveable relative to the lower end ring 12 according to a lateral force exerted by the swellable sealing sleeve 16 on the deformable sleeve 14. Moreover, the deformable sleeve 14 is selectively supported by the lower end ring 12 according to the lateral force exerted by the swellable sealing sleeve 16 on the deformable sleeve 14.

An upper end 20 of the deformable sleeve 14 is received within a complimentary annular recess 22 defined within an axial end face 24 of the upper end ring 10. The deformable sleeve 14 is joined to the upper end ring 10 by a full circle weld 26 which extends around an outer surface of the deformable sleeve 14. The axial end face 24 of the upper end ring 10 is bonded to an upper axial end face 25 of the sealing sleeve 16.

A lower end 30 of the deformable sleeve 14 is received within a complimentary annular recess 32 defined within an axial end face 34 of the lower end ring 12. The axial end face 34 of the lower end ring 12 engages but is unbonded to a lower axial end face 35 of the sealing sleeve 16.

An outer surface of the base pipe 8, an inner surface of the deformable sleeve 14 and the axial end faces 24, 34 of the upper and lower end rings 10, 12 together define an annular chamber 36.

The packer device 6 accommodates one or more control lines 40 in through holes (not shown explicitly in FIG. 1A) formed in the upper and lower end rings 10, 12 and the swellable sealing sleeve 16. The control lines 40 may provide for the transfer of electrical power, for communications and/or for the transfer of fluids through the packer assembly 2 between a tool or device (not shown) located below the packer assembly 2 and a further tool or device (not shown) or a wellhead (not shown) located above the packer assembly 2. The packer device 6 includes an upper retaining cap 42 which is fixed to the upper end ring 10 over the control lines 40 by cap screws 44 to retain the control lines 40 relative to the upper end ring 10. Similarly, the packer device 6 includes a lower retaining cap 46 which is fixed to the lower end ring 12 over the control lines 40 by cap screws 48 to retain the control lines 40 relative to the lower end ring 12.

Figure 2A:
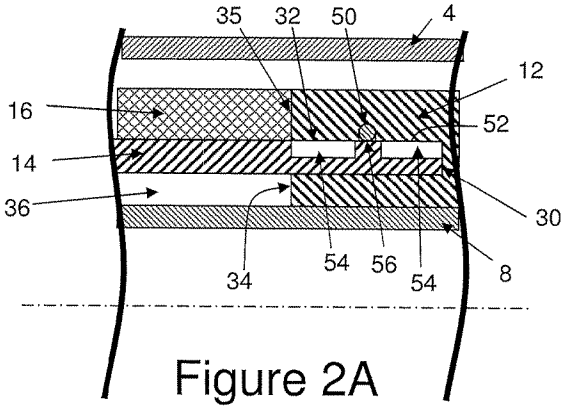
FIG. 2A is a longitudinal cross-section detail of the packer assembly of FIG. 1A in the vicinity of an upper end of a deformable sleeve prior to setting of the packer assembly.

FIG. 2A shows a detailed view of the packer assembly 2 in the vicinity of the lower end 30 of the deformable sleeve 14 prior to setting of the packer assembly 2. The annular recess 32 accommodates an O-ring seal 50 in a sidewall 52 thereof. Two circumferential grooves 54 are defined in an outer surface of the deformable sleeve 14. The circumferential grooves 54 are axially separated so as to define a sealing area 56 therebetween on the outer surface of the deformable sleeve 14. The sealing area 56 has a greater outer diameter compared to the outer diameters of the circumferential grooves 54. As shown in FIG. 2A, before retrieval of the packer assembly 2, the lower end 30 of the deformable sleeve 14 is fully inserted into the annular recess 32 such that the O-ring seal 50 engages and seals against the sealing area 56.

As the packer assembly 2 is run into the wellbore casing 4, the swellable inner O-rings 17, 19 are in an unswollen state and permit well fluids to flow into the annular chamber 36 to equalise pressure internally and externally of the deformable sleeve 14. Following exposure of the inner O-rings 17, 19 to well fluids, the inner O-rings 17, 19 swell and sealingly engage the outer surface of the base pipe 8 and seal the annular chamber 36 from well pressure.

As shown in FIG. 1B, on exposure of the swellable sealing sleeve 16 to a fluid in the wellbore casing 4, the sealing sleeve 16 swells sufficiently to engage an inner wall of the well casing 4 and exert a pack-off force on the inner wall of the well casing 4. The deformable element 14 is sufficiently stiff so that when the deformable element 14 is supported by both the upper and lower end rings 10, 12 as shown in FIG. 1B, the deformable element 14 supports the pack-off force without any significant deformation of the deformable element 14 and prevents fluid flow between the packer assembly 2 and the wellbore casing 4.

To retrieve the packer assembly 2 from the wellbore casing 4 after swelling of the swellable sealing sleeve 16, an initial upward force is applied to the base pipe 8. Depending on the friction forces acting between the outer surface of the swollen sealing sleeve 16 and the inner surface of the wellbore casing 4, this may result in retrieval of the packer assembly 2 from the wellbore casing 4 in a number of different ways.

For relatively low friction forces, a relatively low initial upward force may be sufficient to overcome the friction forces such that neither the sealing sleeve 16 nor the deformable sleeve 14 are deformed to any significant degree as the sealing assembly 2 is pulled out of the wellbore casing 4.

Figure 2B:
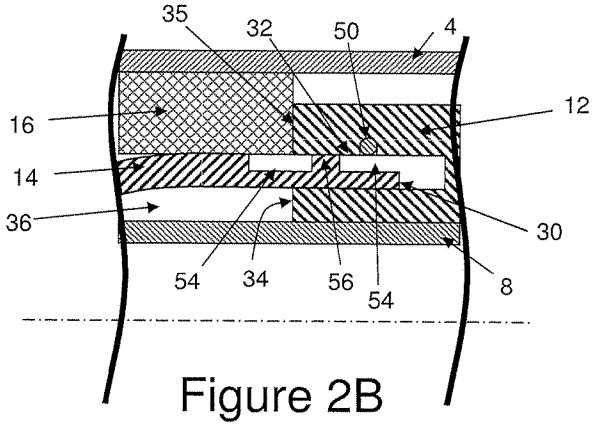
FIG. 2B is a longitudinal cross-section detail of the packer assembly of FIG. 1C in the vicinity of a lower end of the deformable sleeve on application of an initial uphole force to a base pipe of the packer assembly during retrieval of the packer assembly from the wellbore.

If the initial upward pulling force is not sufficient to overcome the friction forces, an increase in the upward pulling force may cause the sealing sleeve 16 to be compressed axially and react on the deformable sleeve 14 as shown in FIG. 1C. The weakness of the deformable sleeve 14 allows it to flex inwards so as to partially withdraw the lower end 30 of the deformable sleeve 14 from the annular recess 32 in the lower end ring 12 as shown most clearly in FIG. 2B. This results in the axial misalignment of the O-ring 50 and the sealing area 56 thereby providing a fluid flow path that extends from the outside of the packer assembly 2 along the interface between the lower axial end face 35 of the sealing sleeve 16 and the upper axial end face 34 of the lower end ring 12, past the sealing area 56, the O-ring seal 50, and the lower end 30 of the deformable element 14 to the annular chamber 36. The fluid flow path thus created permits fluid contained within the annular chamber 36 to be vented from the annular chamber 36 so as to permit further deformation of the deformable sleeve 14. Deformation of the deformable sleeve 14 reduces the friction forces acting between the outer surface of the deformable sleeve 14 and the inner surface of the well casing 4 thereby reducing the upward force required to retrieve the packer assembly 2 from the well casing 4.

If the flexing of the deformable sleeve 14 is insufficient to overcome the friction forces between the outer surface of the sealing sleeve 16 and the inner surface of the wellbore casing 4, then the upward force applied to the base pipe may be increased to overcome the bonding between the upper axial end face 25 of the sealing sleeve 16 and the axial end face 24 of the upper end ring 10. The sealing sleeve 16 then acts on the lower end ring 12 to shear the shear screws 18. This permits the lower end ring 12 to move downwardly thereby de-supporting the lower end 30 of the deformable sleeve 14. This permits the lower end 30 of the deformable sleeve 14 and the sealing sleeve 16 to collapse inwardly to further reduce the friction forces and thereby permit retrieval of the packer assembly 2 from the well casing 4. Downward movement of the lower end ring 12 is arrested when the lower end ring 12 locates against a shoulder 60 defined at an upper end of the lower coupling 9.

Thus, the packer assembly 2 may sequentially adopt one of three different configurations according to the magnitude of the upward force applied to the base pipe 8 that is required to overcome the friction forces acting between the outer surface of the sealing sleeve 16 and the inner surface of the wellbore casing 4. The packer assembly 2 does not require well intervention to de-activate the packer assembly 2 prior to retrieval thereof from the wellbore and at least partially mitigates against any risk of disintegration of the packer assembly 2 and/or damage to the wellbore.

The invention claimed is:

1. A retrievable packer device for use in a wellbore, the retrievable packer device comprising:

first and second end rings configured to be mounted on a base member;

a deformable sleeve extending from the first end ring to the second end ring and configured to extend around the base member; and a swellable sleeve mounted on the deformable sleeve, wherein the deformable sleeve is supported by the first and second end rings, and wherein the swellable sleeve and the deformable sleeve are configured to deform via a pulling force on the base member to permit retrieval of the retrievable packer device from the wellbore.

2. The retrievable packer device according to claim 1, wherein the deformable sleeve is supported by the first and second end rings so as to define a chamber between an outer surface of the base member and an inner surface of the deformable sleeve.

3. The retrievable packer device according to claim 2, wherein the chamber extends axially between the first and second end rings.

4. The retrievable packer device according to claim 1, wherein the deformable sleeve comprises a metal.

5. The retrievable packer device according to claim 1, wherein the deformable sleeve comprises steel.

6. The retrievable packer device according to claim 1, wherein the deformable sleeve has a wall thickness in the range of at least one of 1 to 5 mm, 1.5 to 3 mm and 2 to 2.5 mm.

7. The retrievable packer device according to claim 1, wherein the deformable sleeve is joined to the first end ring.

8. The retrievable packer device according to claim 1, wherein the deformable sleeve is joined to the first end ring around a path defined on at least one of an outer surface of the deformable sleeve and an inner surface of the deformable sleeve.

9. The retrievable packer device according to claim 1, wherein the deformable sleeve is welded to the first end ring.

10. The retrievable packer device according to claim 1, wherein the deformable sleeve is bonded or adhered to the first end ring.

11. The retrievable packer device according to claim 1, wherein the deformable sleeve is formed integrally with the first end ring.

12. The retrievable packer device according to claim 1, wherein the deformable sleeve is sealed relative to the first end ring so as to prevent fluid flow therebetween.

13. The retrievable packer device according to claim 1, wherein the deformable sleeve is selectively sealed relative to the second end ring according to a lateral force exerted by the swellable sleeve on the deformable sleeve.

14. The retrievable packer device according to claim 1, wherein the deformable sleeve is movable relative to the second end ring.

15. The retrievable packer device according to claim 1, wherein an end region of the deformable sleeve is slidingly received within a complementary annular recess defined in the second end ring.

16. The retrievable packer device according to claim 15, wherein the second end ring comprises an O-ring seal located within a circumferential groove defined in a sidewall of the annular recess defined in the second end ring, a surface of the end region of the deformable sleeve defines a sealing area which is disposed towards the O-ring seal, and the sealing area selectively engages the O-ring seal according to a lateral force exerted by the swellable sleeve on the deformable sleeve.

17. The retrievable packer device according to claim 16, wherein the sealing area is defined by circumferential grooves defined in a surface of the deformable sleeve either side of the sealing area.

18. The retrievable packer device according to claim 15, wherein the deformable sleeve comprises an O-ring seal located within a circumferential groove defined in a surface of the end region of the deformable sleeve, a sidewall of the annular recess defined in the second end ring defines a sealing area which is disposed towards the O-ring seal, and the sealing area may selectively engages the O-ring seal according to a lateral force exerted by the swellable sleeve on the deformable sleeve.

19. The retrievable packer device according to claim 18, wherein the sealing area is defined by circumferential grooves defined in the sidewall of the annular recess either side of the sealing area.

20. The retrievable packer device according to claim 1, wherein the deformable sleeve is selectively supported by the second end ring according to a lateral force exerted by the swellable sleeve on the deformable sleeve.

21. The retrievable packer device according to claim 1, wherein the first and second end rings are selectively sealable relative to the base member.

22. The retrievable packer device according to claim 1, wherein the first and second end rings each comprise an inner seal mounted on an inner surface thereof.

23. The retrievable packer device according to claim 22, wherein the inner seal of each of the first and second end rings comprises a swellable material.

24. The retrievable packer device according to claim 1, wherein the swellable sleeve is sealingly mounted on the deformable sleeve.

25. The retrievable packer device according to claim 1, wherein the swellable sleeve is bonded to an outer surface of the deformable sleeve.

26. The retrievable packer device according to claim 1, wherein the swellable sleeve is bonded to the first end ring.

27. The retrievable packer device according to claim 1, wherein the packer device is configured to accommodate a control line.

28. A retrievable packer assembly for use in a wellbore, the retrievable packer assembly comprising a base member and a retrievable packer device mounted on the base member, wherein the retrievable packer device comprises:

first and second end rings mounted on the base member;

a deformable sleeve extending from the first end ring to the second end ring and extending around the base member; and a swellable sleeve mounted on the deformable sleeve, wherein the deformable sleeve is supported by the first and second end rings, and wherein the swellable sleeve and the deformable sleeve are configured to deform via a pulling force on the base member to permit retrieval of the retrievable packer device from the wellbore.

29. The retrievable packer assembly according to claim 28, wherein the first end ring is attached to the base member using at least one connector.

30. The retrievable packer assembly according to claim 28, wherein the second end ring is attached to the base member using at least one frangible connector.

31. The retrievable packer assembly according to claim 28, wherein the second end ring is attached to the base member using at least one shear screw.

32. The retrievable packer assembly according to claim 28, wherein the base member comprises or defines an end stop at or adjacent to an end thereof, and wherein the end stop prevents sliding of the second end ring past the end stop.

33. The retrievable packer assembly according to claim 32, wherein the end stop is defined by a coupling member which permits coupling of the base member to an adjacent further base member.

34. A method of retrieving a packer assembly from a wellbore, the packer assembly comprising:

a base member;

first and second end rings mounted on the base member;

a deformable sleeve extending from the first end ring to the second end ring around the base member; and a swellable sleeve mounted on the deformable sleeve, wherein the deformable sleeve is supported by the first and second end rings, and the method comprises:

exerting a pulling force on the base member so as to deform the swellable sleeve and the deformable sleeve.

35. The method according to claim 34, comprising increasing the pulling force on the base member so as to break a seal between the deformable sleeve and the second end ring and permit fluid to flow between the deformable sleeve and the second end ring.

36. The method according to claim 34, comprising exerting a pulling force on the base member to increase a lateral force exerted by the swellable sleeve on the deformable sleeve to disengage an end of the deformable sleeve from the second end ring thereby de-supporting the end of the deformable sleeve.

37. The method according to claim 34, comprising exerting a pulling force on the base member so as to separate the first end ring from the swellable sleeve.

38. The method according to claim 34, comprising exerting a pulling force on the base member so as to detach the second end ring from the base member.

39. A retrievable packer assembly for use in a wellbore, the retrievable packer assembly comprising a base member and a plurality of retrievable packer devices mounted on the base member, wherein at least one of the retrievable packer devices comprises: first and second end rings mounted on the base member; a deformable sleeve extending from the first end ring to the second end ring and extending around the base member; and a swellable sleeve mounted on the deformable sleeve, wherein the deformable sleeve is supported by the first and second end rings, and wherein the swellable sleeve and the deformable sleeve are configured to deform via a pulling force on the base member to permit retrieval of the retrievable packer device from the wellbore.

* * * * *